US005691523A

United States Patent [19]

Calvo

[11] Patent Number: 5,691,523

[45] Date of Patent: Nov. 25, 1997

[54] MACHINERY SHAFT ALIGNMENT CALCULATOR

[75] Inventor: Frank A. Calvo, Wellington, Fla.

[73] Assignee: Align-it Corporation, Wellington, Fla.

[21] Appl. No.: 758,725

[22] Filed: Dec. 3, 1996

[51] Int. Cl.[6] ..... G06C 27/00

[52] U.S. Cl. ..... 235/78 R; 235/83

[58] Field of Search ..... 235/65, 66, 77, 235/78 R, 83, 84, 88 R

[56] References Cited

U.S. PATENT DOCUMENTS

| | | | |
|---|---|---|---|
| 3,936,957 | 2/1976 | Nordbye | 35/74 |
| 3,937,930 | 2/1976 | Thomas | 235/78 R |
| 3,946,207 | 3/1976 | Williams | 235/88 M |
| 3,958,529 | 5/1976 | Morris | 235/83 |
| 3,986,002 | 10/1976 | DeMaio | 235/78 R |
| 3,992,610 | 11/1976 | Kennedy | 235/61 T |
| 4,026,463 | 5/1977 | Betzler | 235/88 R |
| 4,120,091 | 10/1978 | Borgato | 33/15 B |
| 4,247,757 | 1/1981 | Crump, Jr. | 235/61 J |
| 4,313,054 | 1/1982 | Martini | 235/78 R |
| 4,350,877 | 9/1982 | Yanagisawa et al. | 235/70 A |
| 4,454,409 | 6/1984 | Sehres | 235/78 R |
| 4,835,371 | 5/1989 | Rogers | 235/88 R |
| 4,855,577 | 8/1989 | McLain | 235/78 N |
| 5,189,285 | 2/1993 | Young, Jr. | 235/88 R |
| 5,286,953 | 2/1994 | Marvonek et al. | 235/78 R |
| 5,398,418 | 3/1995 | Jones | 33/1 SD |

*Primary Examiner*—Matthew V. Nguyen
*Attorney, Agent, or Firm*—Steven J. Hultquist

[57] ABSTRACT

An alignment calculator circular slide rule device and associated method for determining shimming requirements for a drive unit to be coupled with a driven unit in angular alignment therewith. The circular slide rule device utilizes drive unit support separation data, coupling structure diameter, and measured angular offset values, to determine shimming requirements for angular alignment of the drive and driven units, by shim addition or removal to the supports of the drive unit.

8 Claims, 9 Drawing Sheets

MACHINERY SHAFT ALIGNMENT CALCULATOR

BACKGROUND OF THE INVENTION

1. Field of the Invention

The present invention relates to a circular slide rule calculator for determining shimming requirements for achieving angular alignment in the coupling of shaft elements of rotational equipment, e.g., electric motors, pumps, compressors, fans, blowers, etc., which are interconnected in the creation of drive and driven unit structures.

2. Description of the Related Art

In the use of motive power drive equipment such as electric motors, combustion engines, etc., and driven equipment, such as pumps, blowers, fan, compressors, turbines, etc., coupled therewith in industrial manufacturing and process plants, there is a need for ensuring proper alignment between the drive shafts and couplings of the interconnected drive and driven units.

More specifically, the alignment between driving and driven shafts must be effected both in a vertical plane as well as a horizontal plane, in order to efficiently convey power in the coupled machinery. If, for example, an electric motor shaft is significantly misaligned in either of the vertical or horizontal planes, the consequences include excessive friction generation in the coupled structures, as well as vibration and heat buildup. These phenomena may in turn cause burn-out of motors and bearings, or seizing of same, melting of system components, and other deleterious phenomena. In the extreme, such misalignment may result in wholesale destruction of a portion of the equipment system including the drive and driven units, such as may occur when a misaligned electrical motor vibrates loose of its support and deforms additional coupled components, creating a substantial risk of physical harm to any workers in proximity to such structures, as well as the destruction of the equipment system itself.

In the field of circular slide rules and calculators, a wide variety of computational devices has been proposed and are in commercial use.

Examples of such prior art devices include: U.S. Pat. No. 3,936,957 issued Feb. 10, 1976 to R. B. Nordbye (a demotic gemstone indicating device, including an adjustable input in the form of precise birth data, and an output portion relating to gemstones, Biblical data, historical and symbolic data related directly to, and associated with, time of birth factors); U.S. Pat. No. 3,937,930 issued Feb. 10, 1976 to F. J. Thomas (rotary calculator for determination of depths of cut or fill required for finish grading, and material quantities to be moved, in site grading applications and surveying operations); U.S. Pat. No. 3,986,002 issued Oct. 12, 1976 to D. A. DeMaio (laser computer in form of circular slide rule for solution of problems relating to laser radar, designation, communications and directed energy communications); U.S. Pat. No. 4,026,463 issued May 31, 1977 to H. Betzler (circular slide rule for determining electrolyte deficiency from measured electrolyte deficiency per volume of serum, body weight and body height); U.S. Pat. No. 4,120,091 issued Oct. 17, 1978 to A. Borgato (hand-held instrument for providing sequential direct readings of true-course, magnetic-course, magnetic-heading, distance and flight times, altitude correction corresponding to actual barometric pressure at sea level, and solutions of wind triangle); U.S. Pat. No. 4,313,054 issued Jan. 26, 1982 to R. M. Martini (circular slide rule for determining operational characteristics of air conditioning and refrigeration systems, with calculation of power consumption, load and part load performance factors); U.S. Pat. No. 4,350,877 issued Aug. 8, 1989 to B. H. McLain (a circular slide rule calculator for establishing ratios of time or distance, on port or starboard tacks during yacht maneuvering to a windward destination); U.S. Pat. No. 4,350,877 issued Sep. 21, 1982 to Y. Yanagisawa, et al. (calculating rule for obtaining ophthalmic values such as near-point distance, and far-point distance, visual range, for making eye glasses); U.S. Pat. No. 4,454,409 issued Jun. 12, 1984 to L. Sehres (bra-size calculator, for computing a bra and cup size from chest, overbust and band measurements); U.S. Pat. No. 4,835,371 issued May 30, 1989 to R. E. Rogers (scuba diving circular slide rule computer for dive planning, calculating increase of pressure within body tissues during a dive and calculating decrease of such pressure after surfacing); U.S. Pat. No. 5,189,285 issued Feb. 23, 1993 to F. D. Young, Jr. (circular slide rule calendar date finder, providing an alignment of a month indicium with a year indicium automatically indicating the dates of the week for dates in that month in that year); and U.S. Pat. No. 5,398,418 issued Mar. 21, 1995 to K. T. Jones (circular or bar-type slide rule for converting golf handicap index into a playing handicap based on slope rating of a golf course).

It is an object of the present invention to provide a circular slide rule for assisting the alignment of drive and driven units which are interconnected with one another.

It is another object of the invention to provide a means and method for adjusting vertical and horizontal plane alignments of interconnected rotational structures to achieve angular alignment thereof.

It is another object of the present invention to provide a means and method of determining shimming adjustments necessary for coupling of a shaft of a motive power drive means to a driven shaft of a corresponding driven unit coupled therewith, to achieve angular alignment between the drive and driven units.

Other objects and advantages of the present invention will be more fully apparent from the ensuing disclosure and appended claims.

SUMMARY OF THE INVENTION

The present invention relates to an alignment calculator circular slide rule device for determining angular alignment position information for effecting alignment of coupled structures, e.g., coupled shaft elements of interconnected drive and driven units.

The alignment calculator circular slide rule device of the invention comprises a lower disc comprising indicia circumferentially arranged thereon denoting shim dimensional characteristics for angular alignment of the drive and driven units, and optionally including indicia denoting spacing between front and rear support points of a drive unit to be coupled by a coupling structure with a driven unit; an upper disc coaxially coupled to the lower disc, including an inner ring portion having circumferentially arranged thereon indicia denoting diameter of the coupling structure and an outer ring portion having circumferentially arranged thereon indicia denoting gap offset values, the upper disc including an annular window portion permitting viewing of the lower disc indicia when the upper and lower discs are coaxially coupled to one another; an index arm having an inner end portion which is coaxially coupled to the coaxially coupled upper and lower discs; and a coupling member coaxially interconnecting the index arm, upper disc and lower disc, permitting independent rotational motion of each of same relative to the others.

In another embodiment, the alignment calculator circular slide rule device broadly described above includes a further top disc, overlying and coaxially coupled to the upper and lower discs, and underlying the index arm, having circumferentially arranged thereon indicia denoting the distance from the coupling structure to the rear support points of the drive unit. In such three disc embodiment, the lower disc includes indicia thereon denoting the distance from the coupling structure to the front support points of the drive unit.

The alignment calculator circular slide rule device first broadly mentioned above is used by determining the linear distance between front and rear support points on the drive unit (in the shaft-wise direction of the interconnected units), and setting the coupling diameter value from the coupling diameter indicia of the upper disc by angular movement of the upper and lower discs relative to one another, so that such linear distance between drive unit front and rear support points is located on the indicia of the lower disc and registered with the coupling structure diameter on the inner ring portion of the upper disc. The angular alignment is measured between coupling members of the drive and driven units, yielding a measured gap offset, and the index arm of the alignment calculator circular slide rule device is rotated to such measured gap offset value on the outer ring portion of the upper disc, while maintaining the upper and lower discs in their prior position relative to one another, and reading the required shim size on the indicia of the lower disc, between the inner and outer ring portions of the upper disc, as aligned with the index arm. If the measured gap offset is larger at the top of the coupling structure than at the bottom thereof, shims are added to both of the drive unit rear support points, and if the gap measured is larger at the bottom than at the top of the coupling structure, shims are added to the drive unit front support points.

For horizontal plane adjustment, the drive unit angle is adjusted side to side, to make offset corrections.

In lieu of measuring the linear distance between drive unit front and rear support points, the lower disc may have frame size and support points separation distance indicia arranged circumferentially at a radially inner portion thereof, with windows being provided in the upper disc, in radial registration with the drive unit frame size and drive unit support points separation distance indicia, whereby for a given frame size of the drive unit, the support points separation distance can be correspondingly determined.

Utilizing the alignment calculator circular slide rule device in the further embodiment described above, utilizing upper and lower discs and a top disc having indicia denoting the drive unit rear support points distance to the coupling structure, the angular alignment process is carried out as follows.

First, the linear distance between the drive unit front support points and the center line of the coupling structure between the drive and driven units is measured, denoted as dimension A. Next, the linear distance between the coupling structure center line and the rear support points of the drive unit is determined, denoted as dimension B.

The gap offset of the coupling structure then is measured at top and bottom positions thereof. The coupling structure diameter, denoted C, is located on the coupling diameter indicia of the upper disc, and such value is placed in registration with the linear separation distance between the coupling structure and the drive unit front support points, A, on the indicia of the lower disc. The drive unit rear support points separation distance, B, is located on the indicia of the top disc, and such top disc value is then aligned by movement of the top disc, to register with the coupling diameter value previously determined. With such positions of the upper, lower and top discs established, all discs are held in position, while the index arm is moved and registered with the measured gap offset value on the indicia of the outer ring portion of the upper disc. The shim requirements for the drive unit front supports then are read from the indicia on the lower disc underlying the index arm, and the shim requirements for the drive unit rear supports are read from the top disc indicia in alignment with the index arm. In such methodology, when the measured gap offset is larger at the top of the coupling than at the bottom thereof, shims must be added to the drive unit support points. If the measured gap is larger at the bottom than at the top of the coupling structure, shims must be removed from the drive unit support points.

It will be appreciated from the foregoing that the alignment calculator circular slide rule device of the present invention affords a ready and convenient means and associated method for determining shim requirements for angular alignment of coupled structures.

Other aspects, features and embodiments of the invention will be more fully apparent from the ensuing disclosure and appended claims.

DETAILED DESCRIPTION OF THE INVENTION, AND PREFERRED EMBODIMENTS THEREOF

The alignment calculator circular slide rule device of the present invention facilitates adjustments to the base of drive or driven units, to bring the shaft center lines of the drive and driven structures which are to be coupled to one another, into aligned position with one another, i.e., so that the center line axes of the respective shaft members of the driving and driven units are adjusted to be substantially coaxial with one another. Such alignment typically requires four distinct adjustments to be done in sequential fashion. Generally, the driving structure will be adjusted in relation to the driven structure, the latter remaining fixedly positioned during the adjustment, as the alignment is made.

The driven structure may comprise equipment units such as blowers, fans, compressors, pumps, gear boxes, power take-off shafts, or other structure or assembly, coupled with the motive driver unit.

Figure 1:
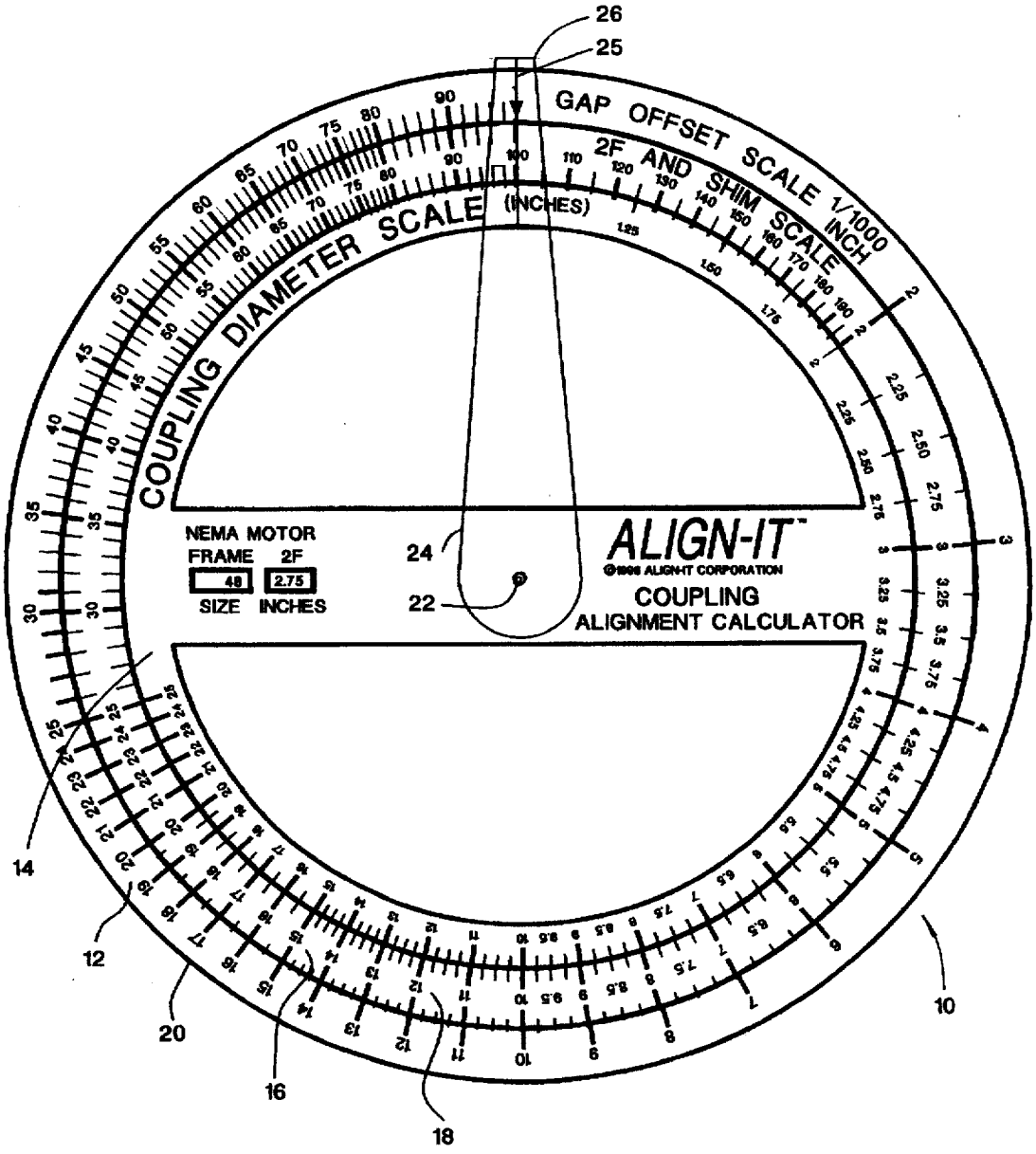
FIG. 1 is a top plan view of an alignment calculator circular slide rule device of the present invention, in one embodiment thereof.

Referring now to the drawings, FIG. 1 is a top plan view of an alignment calculator circular slide rule device according to one embodiment of the present invention.

The device 10 comprises an upper disc including an outer ring segment 12 and an inner ring segment 14, with a transparent window 16 therebetween, and a lower disc 18. The upper disc 20 may be constructed with the outer ring portion 12, annular-shaped window 16, and inner ring portion 14 forming a unitary structure. For such purpose, the annular-shaped transparent window 16 between the outer ring portion 12 and inner ring portion 14 may be constructed from a single sheet of transparent material having a diameter equal to the outer diameter (measured diametrically between opposite circumferential points) of outer ring portion 12, and with the outer ring portion 12 and inner ring portion 14 being adhered or laminated to such disc of transparent material, to form the upper disc structure.

The lower disc 18 may be formed with a diameter equal to the outer circumferential diameter of the outer ring portion 12 of the upper disc, to provide a base structure against which the upper disc may be rotated, to calculate alignment information as hereinafter more fully described. For such purpose, a central coupling rivet 22 or other connection means may be employed, which extends through and couples the upper and lower discs, so that they may independently rotate in relation to one another.

Overlying the upper disc 20 of the alignment calculator circular slide rule device is an index arm 24 having an index line 25 along its length. The index arm is interconnected by rivet connection 22 to the upper/lower disc assembly, such that the index arm is rotatable in either direction (clockwise or counterclockwise) by manual movement of the radially outer end portion 26 of the index arm. The index arm, although illustratively shown as extending beyond the radius of the upper and lower discs, may be of a substantially equivalent radius thereto, and it may simply be moved by manual pressure exerted on the index arm at a point along its length so that the index arm as a result is rotatable over the upper disc 20.

Figure 2:
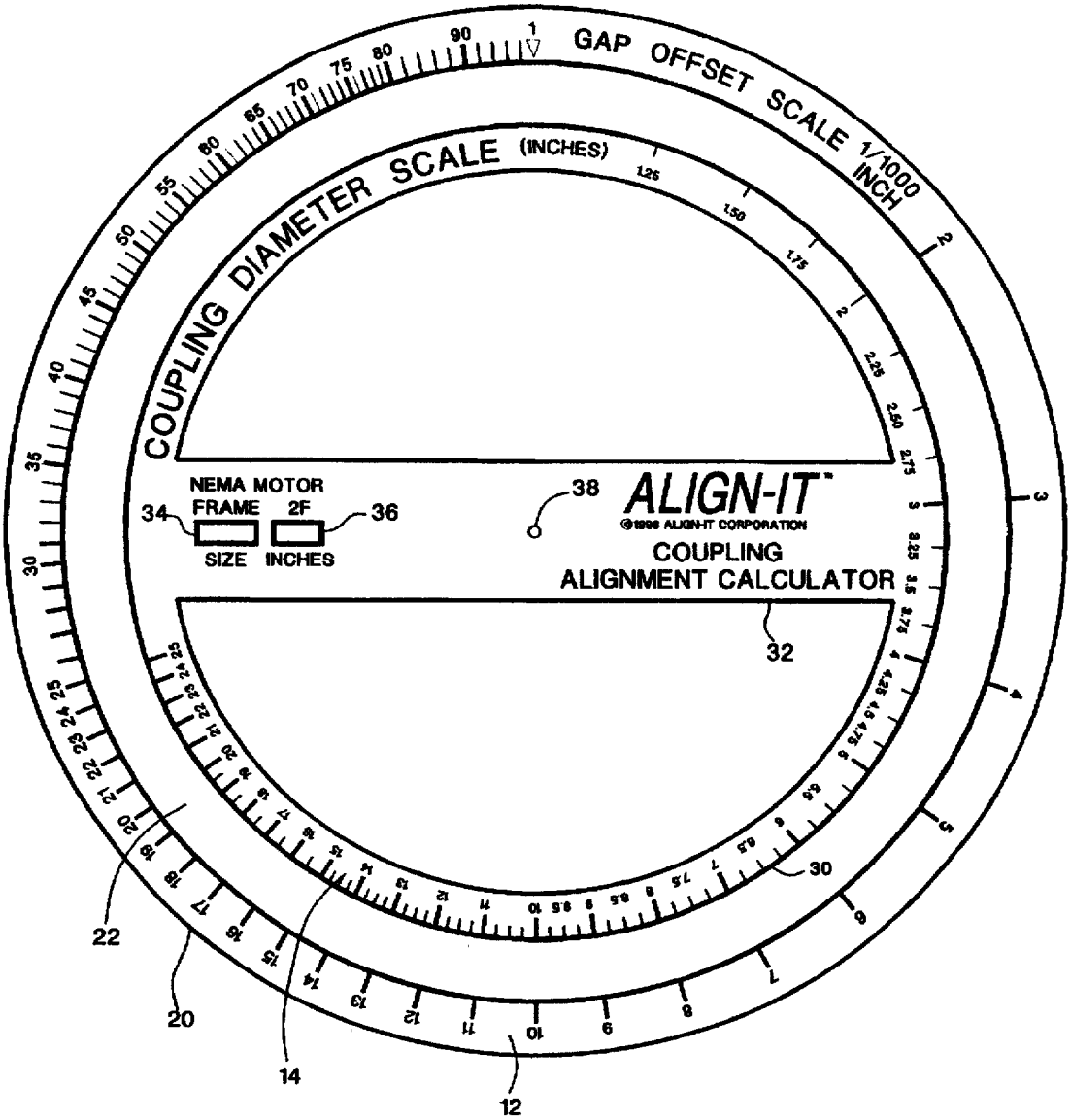
FIG. 2 is a top plan view of the upper disc of the FIG. 1 device.

FIG. 2 is a top plan view of the upper disc 20 of the FIG. 1 alignment calculator circular slide rule device, comprising a gap offset scale, measured in 1/1000ths of an inch, on the outer ring portion 12. The annular-shaped window 22 may as mentioned be a visible portion of a disc of suitable transparent polymeric material such as polyvinylchloride, acetate, transparent Mylar material, or other suitable material of construction, arranged in relation to the outer ring portion 12 and inner ring portion 14 as previously described.

The inner ring portion 14 comprises an annular ring segment 30 and a diametrically extending yoke segment 32 integral therewith at the outer peripheral ends of the yoke segment.

In such fashion, the upper disc 20, comprising the respective ring portions and intermediate annular window 22, defines an outer ring portion with indicia denoting the gap offset scale for the alignment calculation. The inner ring portion 14 on its annular ring segment 30 has indicia thereon denoting the coupling diameter scale, in inches, for the alignment. Thus, the gap offset scale indicia on the outer ring portion 12 and the coupling diameter scale indicia on the inner ring portion 14 are circumferentially arranged on the respective ring portions. The yoke segment 32 of the inner ring portion contains a Frame Size window opening 34 and a Motor Base Length (2F) window opening 36 on the left-hand portion of the yoke segment as shown in FIG. 2.

The yoke segment 32 of the inner ring portion has a central opening 38 accommodating passage of a rivet or other coupling means therethrough, e.g., the coupling rivet shown in FIG. 1.

The window openings 34 and 36 may simply be cut-out openings in the structure of the upper disc 20, or such windows may overlie a base sheet of transparent or window material, as part of a circular disc base structure of such material, which includes annular-shaped window 22.

Thus, the outer ring portion 12 and inner ring portion 14 may be formed of paper, cardboard, plastic film or other suitable material construction, and may be sandwiched and adhesively affixed to the circular sheet of window material forming annular-shaped window 22, or otherwise may be laminated with such base transparent sheet, to form a unitary, conjoint structure, which unitarily is movable in relation to the lower disc 16 of the alignment calculator circular slide rule device.

Figure 3:
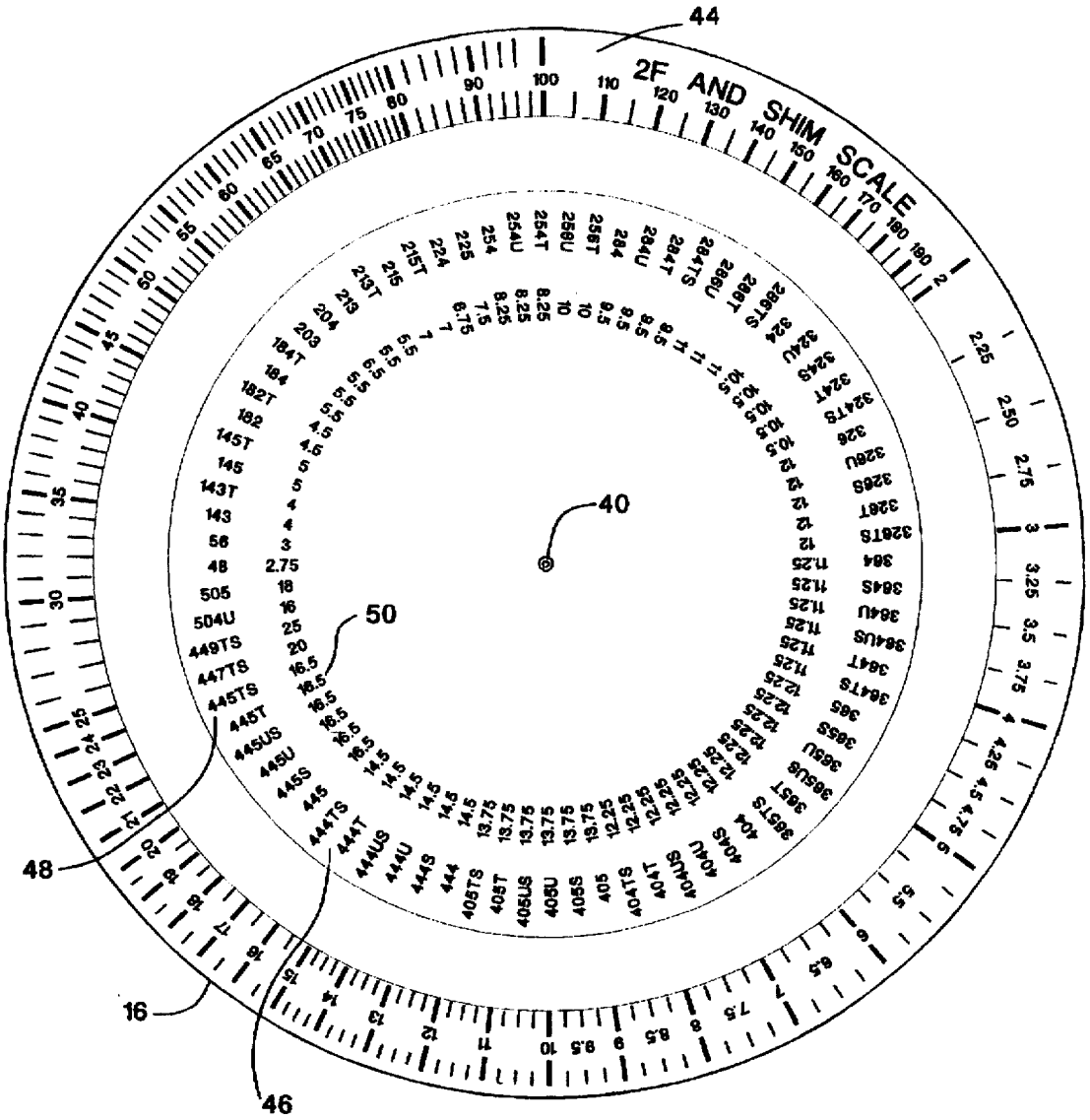
FIG. 3 is a top plan view of the lower disc of the FIG. 1 device.

FIG. 3 is a top plan view of the lower disc 16 of the alignment calculator circular slide rule device of FIG. 1, showing the details thereof.

As shown, lower disc 16 is provided with a central opening 40 accommodating coupling means such as the aforementioned coupling rivet 22 of FIG. 1, for interconnecting the upper and lower discs in rotatable relationship viz a vis one another.

The outer peripheral portion 44 of the lower disc 16 has indicia thereon constituting a Motor Base Length (2F) and Shim Scale, arranged in circumferentially extended fashion about the periphery of such disc.

The lower disc further comprises an inner annular portion 46, having Motor Frame Size indicia 48 on an outer peripheral part of such portion of the lower disc, and at a smaller radius thereof, indicia 50 of Motor Base Length (2F) dimensions, wherein each indicium of the Motor Base Length indicia 50 corresponds to a Motor Frame Size indicium of indicia 48.

Accordingly, when the upper disc 20 of FIG. 2 is coaxially mated with the lower disc 16 of FIG. 3, by passage of a coupling rivet, pin, or other connection means through upper disc central opening 38 and lower disc central opening 40, and with attachment of the index arm 24 as previously described, there is constituted an alignment calculator circular slide rule device as shown in FIG. 1.

Figure 4:
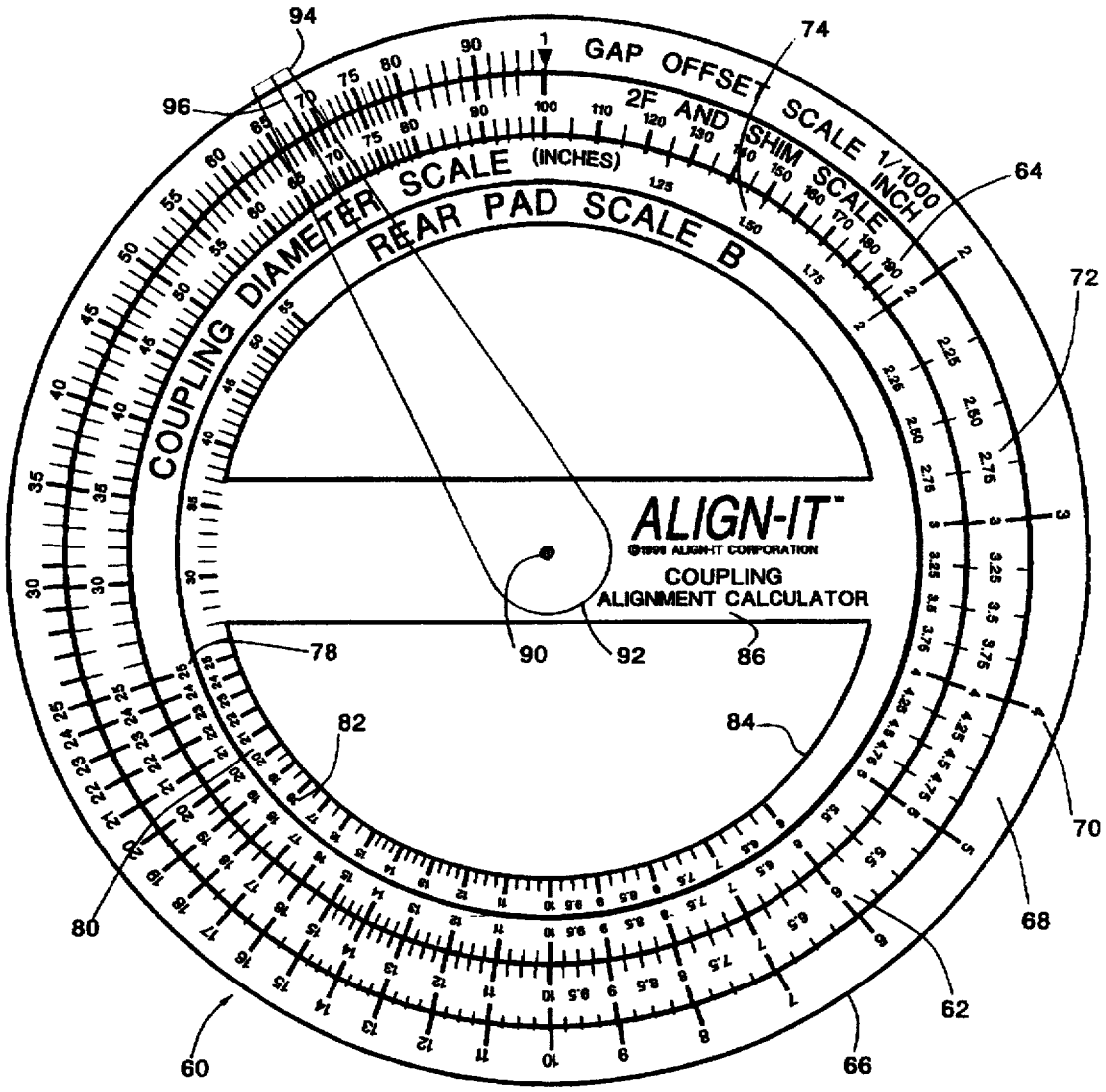
FIG. 4 is a top plan view of an alignment calculator circular slide rule device according to another embodiment of the invention.

FIG. 4 is a top plan view of an alignment calculator circular slide rule device, according to another embodiment of the present invention.

The alignment calculator circular slide rule device 60 shown in FIG. 4 comprises a lower disc 62 including the 2F scale indicia 64 circumferentially arranged thereon.

The alignment calculator device 60 further comprises an upper disc 66, comprising outer ring portion 68 having Gap Offset Scale indicia 70 thereon, along the circumferential surface thereof. The Gap Offset Scale is set out in units 1/1000th inch. The upper disc 66 further comprises a window 72 of clear plastic or other transparent material for viewing of the indicia 64 of the 2F and Shim Scale on the lower disc 62. The upper disc 66 further comprises an inner ring segment 74 having Coupling Diameter Scale indicia 78 circumferentially arranged thereon, in units of inches.

The calculator device 60 further comprises a top disc 80 having Rear Pad Scale B indicia 82 circumferentially arranged thereon. The top disc 80 comprises ring portion 84 and yoke portion 86, the yoke portion being integrally joined to the ring portion 84 at the opposite end extremities of the yoke portion.

The respective lower, upper and top discs are rotationally interconnected by means of rivet connector 90, to which is also coupled for rotation an index arm 92 having an outer radial end portion 94 for manual grasping and angular movement of the index arm. The index arm 92 features alignment line 96, which may be printed, scribed, or otherwise present on the index arm and which provides a means of reading exact or interpolated values of indicia on the alignment calculator device.

The operation of the alignment calculator device embodiments of FIGS. 1–4 will be more fully apparent from the ensuing description, in reference to a coupled drive unit and driven unit assembly, which is aligned with the assistance of the alignment calculator device and method of the present invention.

Figure 5:
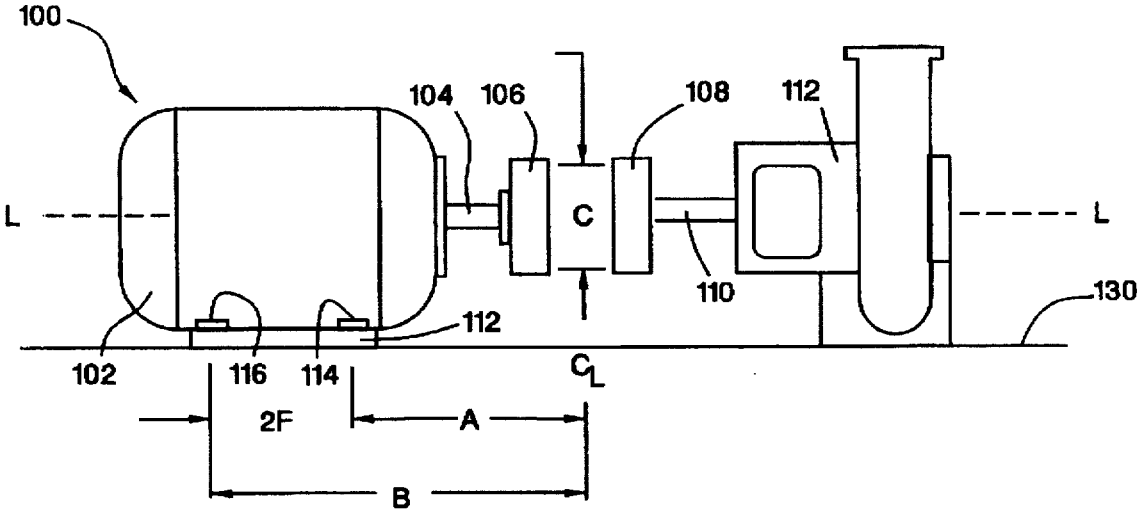
FIG. 5 is a schematic elevation view of a motor and stationary driven unit assembly, which may be aligned in accordance with the present invention.

FIG. 5 is a schematic elevation view of a drive and driven units assembly 100, including a drive motor 102 with drive shaft 104 communicating with shaft coupling member 106. The coupling member 106 is shown in facing relationship to a complimentary coupling member 108 mounted on driven shaft 110 of the driven unit 112. The driven unit 112 may, for example, comprise a fluid pump, compressor, blower, or other motive driven apparatus, connectable by complimentarily mating the coupling members 106 and 108 with one another.

The drive motor 102 is reposed on a base 112, by means of front pads 114 and rear pads 116. The terms "front" and "rear" are adopted in relation to the shaft 104 of the drive motor, with the from pads of the motor being those closest to the shaft, and the rear pads being those farthest away. Inasmuch as FIG. 5 is a side elevation view, it will be appreciated that the rear side (in relation to the front side shown) is equipped with corresponding front and rear pads to those illustrated on the front side. As used herein, the term "support point" refers to the center or centroidal point of such pads (or other support structures such as footings, pedestals, etc.)

The linear distance parallel to the central axis of shaft 104, measured between the front pads 114 and rear pads 116 of the drive device, is shown in the drawing as the quantity (B-A), and sometimes hereinafter is referred to as the motor base length (2F). In the expression (B-A), the dimension A shown in the drawing is the linear distance from the front pads to the center of the coupled shaft assembly comprising coupling members 106 and 108, which are interconnected with one another in a known manner. Correspondingly, the dimension B is the linear distance from the center of the coupling assembly to the rear pads. Thus, the quantity (B-A) represents the 2F linear distance between the front and rear pads of the mounted drive motor.

Figure 6:
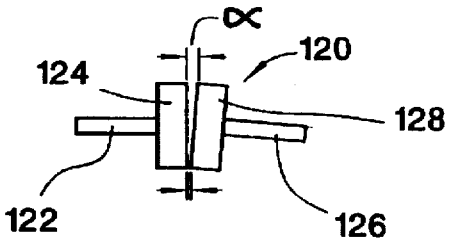
FIG. 6 is a schematic elevation view of drive and driven shaft assemblies, showing angular misalignment.

FIG. 6 is an elevation view of a driving and driven unit coupling assembly 120, comprising drive shaft 122, drive shaft coupling member 124, driven shaft 126 and driven shaft coupling member 128. As shown in the drawing, there is angular misalignment between the coupling members 124 and 128, resulting in a gap angle $\alpha$ at the top end of the coupling members, which in consequence of the misalignment are in abutting relationship to one another only at the bottom ends of the respective coupling members.

FIGS. 5 and 6 thus show the coupled shaft assemblies in the vertical plane (the vertically plane being a plane perpendicular to the generally flat and horizontal surface 130 on which the driving and driven units are disposed, with such vertical plane passing through the central axis L—L of the shafts 104 and 110 when same are properly coaxially aligned with one another).

It will be appreciated from inspection of the misalignment in the vertical plane illustratively depicted in FIG. 6 that the gap between the coupling members 120 and 124 of the driven and driving units must be equal for aligned operation, so that the gap at top dead center of coupling members 120 and 124 is equal to the gap at bottom dead center.

Figure 7:
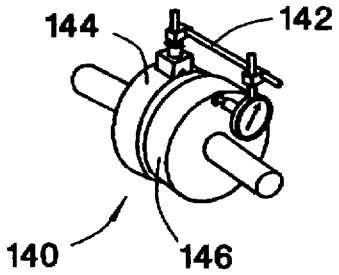
FIG. 7 is a perspective view of drive and driven shaft assemblies, with a dial indicator being employed to determine the extent of angular misalignment.

The existence and extent of angular misalignment can be variously measured. FIG. 7 shows a driving and driven unit assembly 140 having a dial indicator 142 mounted on the respective coupling members 144 and 146, as shown, whereby the dial readout provides the angular misalignment reading.

Figure 8:
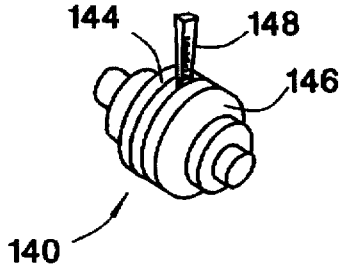
FIG. 8 is a perspective view of drive and driven unit assemblies, with a taper gauge being employed to determine the extent of angular misalignment.

FIG. 8 is a perspective view of the same driving and driven unit assembly, wherein the gap between the coupling members 144 and 146 is measured by a taper gauge 148 which is inserted into the top dead center gap in the illustrated apparatus configuration, to provide visual measurement of the extent of misalignment at top dead center.

Figure 9:
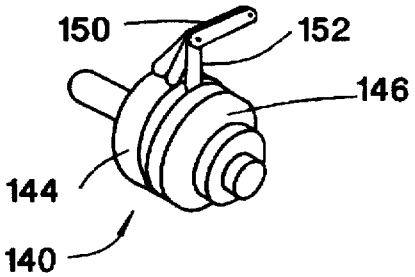
FIG. 9 is a perspective view of drive and driven unit assemblies, utilizing a feeler gauge to determine the extent of angular misalignment.

FIG. 9 is a perspective view of the same driving and driven unit assembly 140, wherein the top dead center misalignment between the coupling members 144 and 146 is measured with a feeler gauge 150 having a plurality of gap measuring feeler elements 152, which are sequentially applied to the gap between the coupling members 144 and 146, to ascertain the gap dimension at top dead center in the assembly.

Figure 10:
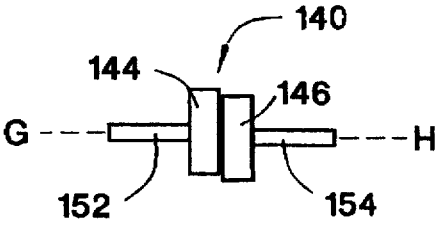
FIG. 10 is an elevation view of drive and driven shaft assemblies, having parallel or vertical plane misalignment.

In addition to the vertical plane angular misalignment illustrated in FIG. 6, the driving and driven units assembly may experience parallel misalignment in the vertical plane, as shown in FIG. 10, wherein the driving and driven unit assembly 140 comprises driving shaft 152 and driven shaft 154 associated respectively with coupling members 144 and 146, wherein coupling member 144 is elevationally above the coupling member 146. In such misalignment conformation, the facing surfaces of coupling members 144 and 146 are parallel to one another, however the central axis G of shaft 152 is above and parallel to the central axis H of shaft 154.

Figure 11:
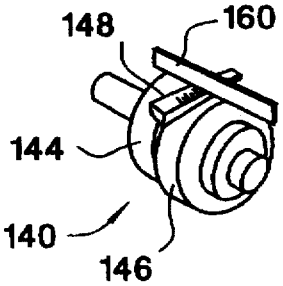
FIG. 11 is a perspective view of drive and driven unit assemblies, wherein a level and taper gauge are employed to determine the extent of vertical plane parallel misalignment.

FIG. 11 shows a driving and driven unit assembly 140 in which the degree of parallel misalignment in the vertical plane between coupling member 144 and coupling member 146 is measured with a straight edge 160 being reposed on the top circumferential surface of the coupling member 144, which is elevationally above the coupling member 146. With the straight edge 160 so positioned, a taper gauge 148 is inserted between the bottom edge of the straight edge and the circumferential top surface of coupling member 146. The taper gauge is inserted into the gap between the circumferential surface of coupling member 146 and the bottom of straight edge 160, until the taper gauge 148 is snugly engaged therebetween, at which point the parallel misalignment reading is taken from the taper gauge.

Figure 12:
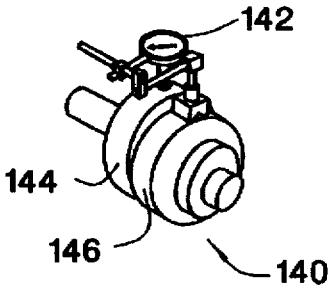
FIG. 12 is a perspective view of drive and driven unit assemblies, wherein a dial indicator is employed to determine the extent of vertical plane parallel misalignment.

FIG. 12 is a perspective view of a driving and driven unit assembly 140 which is parallelly misaligned in the vertical plane, showing a dial indicator 142 mounted on the adjacent circumferential top surfaces of coupling members 146 and 144, to provide a reading on the dial indicator of the extent of parallel misalignment.

Figure 13:
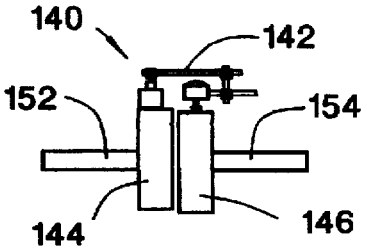
FIG. 13 is an elevation view of a drive and driven shaft unit assembly, showing a dial indicator as being positioned for determining the extent of parallel misalignment.

FIG. 13 is a front elevation view of a driving and driven unit assembly 140 including drive shaft 152 and associated coupling member 144, in facing relationship to coupling member 146 mounted on driven shaft 154. In such arrangement a dial indicator 142 is shown on the top center circumferential surfaces (cylindrical side surfaces of the coupling members), from which top position the dial indicator is rotated to the opposite bottom center position when the coupling members are correspondingly rotated.

Figure 14:
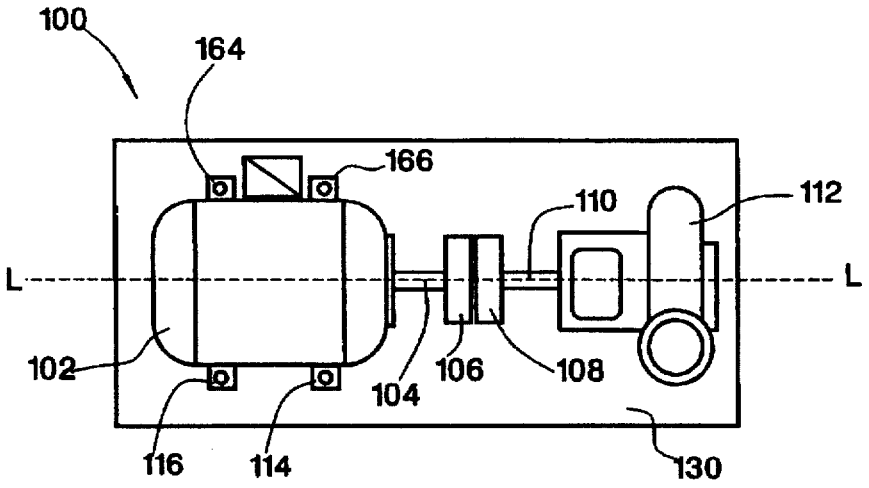
FIG. 14 is a top plan view of a drive motor and driven unit assembly, which may be angularly and parallelly aligned in accordance with the present invention, in the horizontal plane.

FIG. 14 is a top plan view of a driving and driven unit assembly 100 including a drive motor 102 having drive shaft 104 joined to coupling member 106. The coupling member 106 is coupled with coupling member 108. The coupling member 108 in turn is mounted on shaft 110 of driven unit 112, and the entire unit is mounted on floor or support structure 130. The motor is mounted on an associated base (not shown in FIG. 14; see FIG. 5) by means of rear pads 116 and 164 and front pads 114 and 166.

The horizontal plane alignment characteristics for such driving and driven unit assembly 100 is determined in relation to a plane parallel to the support surface 130 and extending through the center line L—L when the respective driving and driven shafts 104 and 110 are coaxially arranged with respect to one another.

Figure 15:
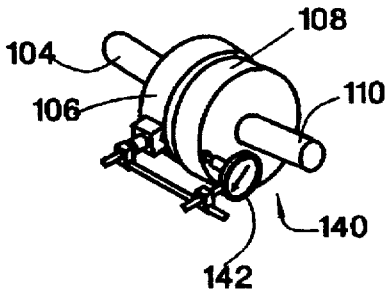
FIG. 15 is a perspective view of drive and driven unit assemblies, including dial indicators arranged to determine the extent of angular misalignment in the horizontal plane.

FIG. 15 is a perspective view of the driving and driven unit assembly 140 comprising drive shaft 104 joined to coupling member 106, and coupling member 108 mounted on driven shaft 110, with an indicating gauge 142 arranged to determine the extent of angular misalignment of the driving and driven unit assembly 140 in the horizontal plane.

Figure 16:
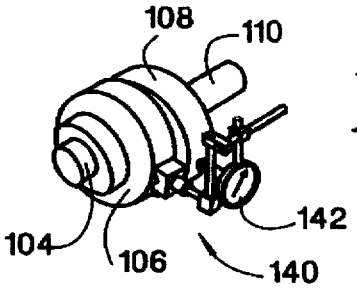
FIG. 16 is a perspective view of drive and driven unit assemblies, showing a dial indicator positioned to determine the extent of parallel misalignment in the horizontal plane.

FIG. 16 is a perspective view of a driving and driven unit assembly 140 comprising drive shaft 104 having coupling member 106 mounted thereon, in facing relationship to coupling member 108 mounted on driven shaft 110. An indicating gauge 142 is shown as being arranged to measure the parallel misalignment of the respective coupling members 106 and 108, ancillary to the measurement of angular misalignment in FIG. 15 in the horizontal plane.

Figure 17:
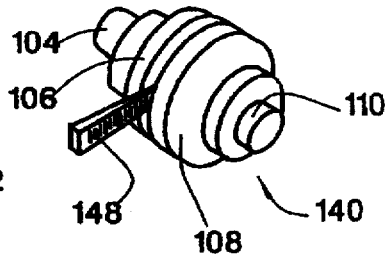
FIG. 17 is a perspective view of drive and driven unit assemblies, wherein a taper gauge is employed to determine the extent of angular misalignment in the horizontal plane.

FIG. 17 is a perspective view of a driving and driven unit assembly 140, in which the drive shaft 104 is joined to coupling member 106 in facing relationship to coupling member 108 on driven shaft 110, and with a taper gauge 148 being inserted between the opposing faces of the coupling members, for determination of the extent of angular misalignment therebetween in the horizontal plane.

By the use of such gauge and indicating means the quantitation of the angular and parallel alignment characteristics can be readily determined in both the vertical and horizontal planes of a given driver and driven units assembly.

In the set-up of driving and driven units assemblies, the respective shafts and associated coupling members for accurate alignment must be aligned both angularly and parallelly in the vertical plane, so that the shafts and coupling members are coaxial with and in coupling registration with one another. In this regard, the respective shafts and coupling structures must be angularly and parallelly aligned in the horizontal plane, to ensure the coaxial registration of respective shafts and coupling members with respect to one another.

The angular alignment of shafts in a vertical plane will now be described, with reference to the alignment calculator circular slide rule device of the present invention.

With the driving and driven unit assemblies in preliminary position in relation to one another, the gap between the driving and driven unit coupling members at top dead center and bottom dead center are measured using a feeler gauge, taper gauge, vernier caliber or dial indicator, as previously described. The measurements are employed with the alignment calculator device, utilizing the base and coupling member dimensions, to find the required shim size for shimming the driving unit, to place the driving unit in proper angular alignment with the driven unit.

With reference to FIG. 1, the Coupling Diameter Scale on the inner ring portion 14 of the calculator device is visually inspected to locate the coupling diameter in inches, for the coupling members involved. This coupling diameter is then by rotation of the upper disc 20 placed in angular radial alignment with the Motor Base Length (2F) on the 2F scale of the lower disc 16.

Next, the measured gap offset, as measured with the aforementioned measurement tools, is located on the Gap Offset Scale on outer ring portion 12 of the upper disc. The index arm 24 then is rotated until the index line 25 is aligned with such gap offset value. The required shim size for effecting alignment of the coupling members and respective shafts then is read at the intersection of the index line 25 on the 2F scale of the lower disc 16.

The appropriate shim then is inserted at the appropriate pair of front pads or rear pads of the motor 102 (see FIGS. 5 and 14). If the measured gap offset value is larger at the top of the coupling (i.e., as in the conformation shown in FIG. 6), the shims at the determined thickness should be added to both of the rear motor pads, being inserted between the pads 116 and 164 and the base or surface on which the motor is mounted (see FIG. 14). If the gap offset is larger at the bottom of the opposedly facing coupling members 124 and 128 (see FIG. 6), the shims of the determined dimensional character should be added to both front pads 114 and 166 (see FIG. 14).

For vertical plane parallel alignment, using a dial indicator device, the dial indicator is mounted to the motor shaft or coupling member of the driving and driven units assembly. The dial point is set on the driven unit coupling member outer diameter at top dead center. The shafts of the respective driving and driven units are then are turned together to the bottom dead center. Shims equaling the thickness of half of the measured offset then are placed under all four motor pads 114, 116, 164 and 166. This procedure is repeated, and shims are added or removed as necessary until parallel alignment is achieved.

If instead of a dial indicator device, a straight edge is used, as depicted in FIG. 11, shims equaling the total offset must be placed under all four motor base pads in the parallel alignment procedure.

For horizontal angular and parallel alignment, adjustments are performed in a manner analogous to the procedures for vertical plane angular alignment and vertical plane parallel alignment as described above, except that shims are not added or removed.

For vertical plane angular alignment calculation using the alignment calculator device shown in FIG. 4, the following procedure is employed.

First, the dimension A as shown in FIG. 5 is measured, i.e., from the center of the coupling assembly to the front motor pads of motor 102. Next, the dimension B is measured, from the center of the coupling assembly to the rear motor pads 116.

The gap offset of the coupling member faces at top dead center and bottom dead center are next measured, utilizing a dial indicator, feeler gauge, taper gauge, vernier caliber, or other suitable angular gap measurement tool.

Using the alignment calculator device of FIG. 4, the coupling member diameter C (see FIG. 5) is located on the Coupling Diameter Scale on ring portion 74, and such ring portion is rotated into registry with the front motor pad dimension A on the 2F scale of the lower disc 72, so that the indicia of the 2F scale is positionally matched to the coupling member diameter C from the indicia 78 of ring portion 74.

The rear motor pad dimension B then is located on the Rear Pad Scale B on the indicia 82 of the ring segment of top disc 84, and the top disc then is rotated until such rear pad dimension B is brought into radial registration with the Coupling Member Diameter indicium on inner ring portion 74 of the upper disc 66. With all the scales (respective discs) set and held in position, the index arm 92 is rotated until the index line 96 is radially registered with the measured gap offset on the Gap Offset Scale of upper disc outer ring portion 68. The shim dimension for the front pads of the drive unit then is read on the 2F and Shim Scale of lower disc 62, and the shim dimensional requirements for the rear pads are read off the top disc ring segment 84, as radially aligned with the index line 96 of the index arm 92. When the angular gap offset is larger at the top of the coupling member assembly, shims must be added to the motor pads. If the angular gap is larger at the bottom of the coupling member assembly, shims must be removed.

It will be recognized that the three disc conformation of the alignment calculator device as illustratively shown in FIG. 4 permits the top disc to be employed to determine shim requirements in one step, relative to a two disc conformation of the alignment calculator device, such as is illustratively shown in FIGS. 1–3 herein.

Accordingly, by use of the alignment calculator circular slide rule device of the present invention, vertical plane angular alignments are readily determined, to effectuate coaxial registration of driving and driven shafts and associated coupling members, and achieve maximum efficiency in operation of the coupled assembly.

Vertical plane angular alignment utilizing the alignment calculator device of the present invention thus achieves a material simplification of the alignment procedure. The angular alignment is readily achieved by mounting of a dial indicator to the motor shaft or coupling member of the drive unit, setting the dial point on the driven unit coupling member outside face and outer-most edge. The movement of the dial point is checked to ensure that it is not "bottomed out" and that the dial indicator is in contact with the coupling as it is rotated through one full turn. Negative travel of the dial indicator requires shims to be added to both of the rear motor pads as calculated on the alignment calculator device. Conversely, positive travel of the dial indicator requires shims to be added to both of the front motor pads as calculated on the alignment calculator device. After the dial indicator set-up is complete, the dial is reset to 0 at the top dead center position. The coupling is slowly rotated to the bottom dead center position, observing the direction of the dial movement, noting whether it is positive or negative. The total travel reading and direction of the dial indicator movement then is recorded. This information then is set on the alignment calculator device to determine the dimensional character of the shims to be added.

The features and advantages of the present invention are more fully illustrated with respect to the following examples.

EXAMPLE I

A pump and motor assembly with a 256T frame motor and a 3.5 inch diameter coupling member are aligned, using dial indicator procedures and the alignment calculator device of FIG. 1.

A dial indicator is attached to the respective coupling members substantially as shown in FIG. 7. The top dead center is set to zero indicator reading and the dial point is placed on the face of one coupling member and outer-most edge of the other coupling member. The coupling is rotated and the dial indicator is correspondingly rotated, to the bottom dead center position. At the bottom dead center position, the top dead center dial reading is zero degrees and the bottom dead center gap offset reading is −0.030 degree.

Using the alignment calculator device shown in FIG. 1, the upper disc is rotated to find the 2F motor base centers for the motor frame size 256T. The alignment calculator device shows the 2F dimension to be 10 inches for the 256T frame size. If the frame size is not listed on the alignment calculator, the motor base pad centers may be measured from the front pad to the rear pad, to yield the 2F dimension.

Figure 18:
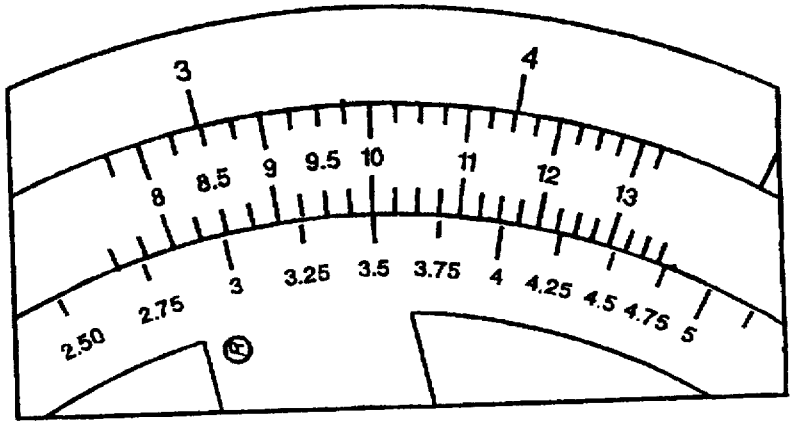
FIG. 18 is a top plan enlarged view of a portion of the alignment calculator circular slide rule device of FIGS. 1–3, illustrating the use of the device in connection with Example I hereof.

The coupling diameter of 3.5 inches then is located on the inner circular portion of the upper disc and such value of 3.5 inches is brought into radial registration with the 2F Scale dimension on the lower disc 2F Scale, so that the coupling diameter value of 3.5 inches is radially registered with the 2F Scale value of 10, as shown in FIG. 18.

Figure 19:
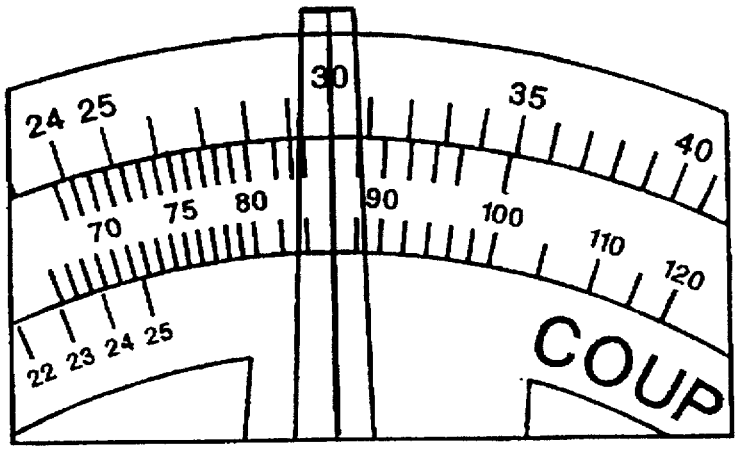
FIG. 19 is a top plan enlarged view of a portion of the alignment calculator circular slide rule device of FIGS. 1–3, including the outer portion of the index arm of such device, in a registered position, illustrating the use of the device in connection with Example I hereof.

Next, the index arm is rotated so that the index line thereof is brought into radial registration with the measured gap offset value on the outer ring portion of the upper disc, while maintaining the previously registered position of the upper and lower discs in relation to one another. The index arm line thus is reposed on the measured gap value of −0.030 inch on the Gap Offset Scale, providing a reading of 0.086 inch shim thickness required, as read on the 2F Scale under the index arm line, as shown in FIG. 19.

In this case, the shims are to be added to the rear motor base pads since the dial indicator travel was negative. The back end of the motor thus is raised 0.086 inch to bring the motor shaft coupling into vertical plane angular alignment with the driven shaft and coupling member.

EXAMPLE II

The horizontal plane angular alignment of the assembly described in Example I is determined, by set-up of the dial indicator as described in Example I, except that readings are made at 90 degrees from top dead center at both sides of the coupling members. After the dial indicator set-up has been effected, the dial is reset to zero at the left side dead center. The coupling assembly then is slowly rotated to the fight side dead center position, observing the direction of dial movement and noting if it is positive or negative. The total travel of the dial point then is recorded.

Positive travel of the dial point requires a clockwise angular change to be made to the motor pads as calculated on the alignment calculator device. Negative travel requires a counterclockwise angular change to be made to the motor pads as calculated on the alignment calculator device.

The index line on the calculator device is moved to the measured side gap of the coupling assembly, while holding the setting for the 2F Scale and the coupling diameter scale in place. The required angular adjustment then is read on the 2F Scale under the index arm line.

The motor base angle next is adjusted with the dial indicator in place, resetting the left side dead center to zero after each move until angular alignment in the horizontal plane is achieved. No shims are added or removed during this phase of alignment.

EXAMPLE III

Vertical plane and horizontal plane parallel alignment is effected on the drive and driven units assembly of Examples I and II.

For vertical plane parallel alignment using a dial indicator device, the dial indicator is mounted to the drive shaft and coupling member of the driven unit. The dial point on the driven unit coupling member outer diameter is set at top dead center. The movement of the dial point is checked to ensure that it is not "bottomed out" and that it is in contact with the coupling as it is rotated through one full turn of the coupling assembly. Negative travel requires shims to be added to each of the four motor base pads equal to one-half the dial indicator reading. Positive travel requires shims to be removed from each of the four motor base pads equal to one-half of the dial indicator reading.

The total shim thickness that can be added or removed from the four motor base pads to achieve vertical plane parallel alignment is determined. After the indicator set-up is complete, the dial is reset to zero at the top dead center position. The coupling is slowly rotated to the bottom dead center position and the direction of dial movement is noted. The dial indicator point during such rotation moves 0.066 inch in a negative direction. This reading indicates that the motor is lower than the driven unit and that the motor requires shims to be added to each of the four base pads. The total dial indicator reading of −0.066 inch is divided in half to determine the required shim size. In this case, 0.033 inch shims are placed under each of the four motor base pads.

For horizontal plane parallel alignment, the motor is moved in a positive or negative direction as dictated by the dial travel and total dial measurement (one-half total reading). Both the front and back of the motor are to be moved the same distance and direction without disturbing the angular alignment, while ensuring that the dial moves from the right direction while the motor is being adjusted. The front and rear of the motor together are moved the same amount while the dial travel is observed. The dial is reset to zero after each move until alignment is achieved. The use of additional dial indicators reading the movement of the front and rear of the motor base pads during this phase of adjustment is preferred.

EXAMPLE IV

A driving and driven unit assembly with a 256T frame motor and a 3.5 inch diameter coupling is aligned using a dial indicator and the alignment calculator device of FIG. 4.

Measurements on the drive and driven unit assembly show dimension A to be 10 inches, dimension B to be 20 inches and dimension C to be 3.5 inches. The dial indicator is positioned at top dead center and set to zero. The respective shafts of the drive and driven unit assembly are rotated together to the bottom dead center. If the dial indicator moves toward negative, adjustment shims will be placed under the motor mounting pads. If the dial indicator moves in a positive direction, shims must be removed from the motor mounting pads. In this example, the dial moves in a negative direction and shims must be added.

Figure 20:
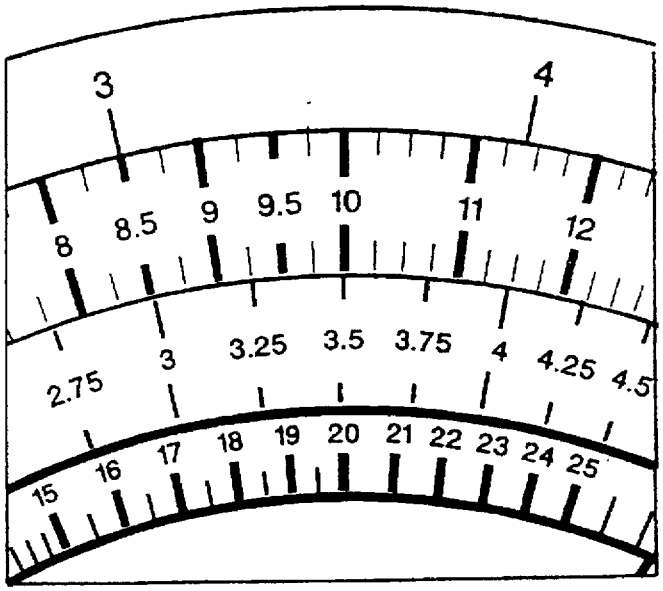
FIG. 20 is a top plan enlarged view of a portion of the alignment calculator circular slide rule device of FIG. 4, illustrating the use of the device in connection with Example IV hereof.

The coupling diameter is set opposite the 2F scale, so that the coupling diameter of 3.5 inches is in register with the 10 inch A dimension on the 2F scale. The rear pad 20 inch dimension then is located on the top disc ring segment and brought into radial registration with the coupling member diameter value of 3.5 inches, as shown in FIG. 20.

Figure 21:
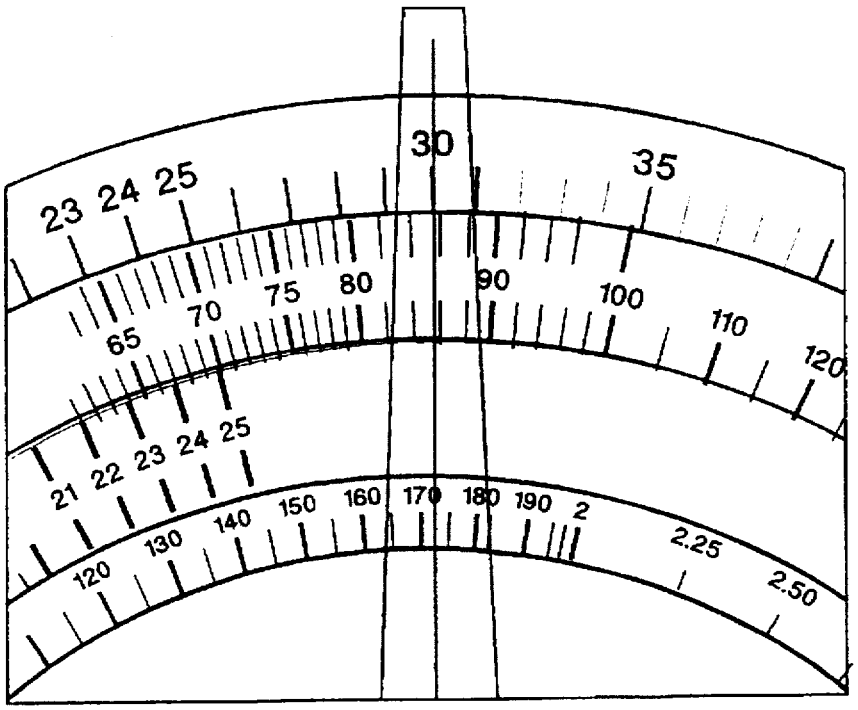
FIG. 21 is a top plan enlarged view of a portion of the alignment calculator circular slide rule device of FIG. 4, including the outer portion of the index arm of such device, in a registered position, illustrating the use of the device in connection with Example IV hereof.

With the lower, upper and top discs maintained in position relative to one another, the index arm is set on the shim scale (gap offset scale) to the measured gap offset value of 0.030 inch, as shown in FIG. 21.

The shim dimension required for shims on the from motor pad then is read from the 2F Scale at the index arm line, and the shim dimension required for the shims to be placed on the read pads of the drive motor is read on Rear Pad Scale B on top disc ring segment 84 under the center line of the index arm.

The shim dimension for the front pads thus is read on the 2F Scale as 0.086 inch and the rear shim dimension of 0.172 inch for rear pad shims is read on the rear pad scale of ring segment 84 on the top disc of the calculator device.

While the invention has been described herein with respect to illustrative embodiments and features, it will be appreciated that the invention is susceptible of other variations, modifications and other embodiments. Accordingly, the invention is to be broadly construed, as including within its spirit and scope as claimed, all such variations, modifications and alternative embodiments.

What is claimed is:

1. An alignment calculator circular slide rule device for determining angular alignment positioning information for effecting alignment of coupled drive and driven units interconnected by coupling structure, comprising:

a lower disc comprising indicia circumferentially arranged thereon denoting shim dimensional characteristics for angular alignment of the drive and driven units by shim adjustment on support points of the drive unit selected from the group consisting of front and rear support points;

an upper disc coaxially coupled to the lower disc, including an inner ring portion having circumferentially arranged thereon indicia denoting diameter of the coupling structure and an outer ring portion having circumferentially arranged thereon indicia denoting gap offset values, the upper disc including an annular window portion permitting viewing of the lower disc indicia when the upper and lower discs are coaxially coupled to one another;

an index arm having an inner end portion which is coaxially coupled to the coaxially coupled upper and lower discs; and a coupling member coaxially interconnecting the index arm, upper disc and lower disc, permitting independent rotational motion of each of same relative to the others.

2. An alignment calculator circular slide rule device according to claim 1, further comprising on said lower disc, indicia denoting spacing between front and rear support points of the drive unit to be coupled to the driven unit.

3. An alignment calculator circular slide rule device according to claim 1, further comprising a top disc, overlying and coaxially coupled to the upper and lower discs, and underlying the index arm, having circumferentially arranged thereon indicia denoting the distance from the coupling structure to the rear support points of the drive unit, and wherein the lower disc includes indicia circumferentially arranged thereon denoting the distance from the coupling structure to the front support points of the drive unit.

4. An alignment calculator circular slide rule device according to claim 1, wherein the upper disc includes a diametrally extending yoke portion diametrally extending between opposite circumferential areas of the inner ring portion, said yoke portion having frame size and 2F indicia viewing windows therein, and said lower disc comprises indicia circumferentially arranged thereon in register with the frame size and 2F viewing windows denoting the frame size and corresponding 2F dimension.

5. An alignment calculator circular slide rule device according to claim 1, wherein the upper disc annular window portion is formed of a transparent material secured to the inner ring portion and outer ring portion of the upper disc, to form a unitary structure.

6. A process for determining angular alignment positioning information for effecting alignment of coupled drive and driven units interconnected by coupling structure, comprising:

providing an alignment calculator circular slide rule device, including:

a lower disc comprising indicia circumferentially arranged thereon denoting shim dimensional characteristics for angular alignment of the drive and driven units by shim adjustment on support points of the drive unit selected from the group consisting of front and rear support points;

an upper disc coaxially coupled to the lower disc, including an inner ring portion having circumferentially arranged thereon indicia denoting diameter of the coupling structure and an outer ring portion having circumferentially arranged thereon indicia denoting gap offset values, the upper disc including an annular window portion permitting viewing of the lower disc indicia when the upper and lower discs are coaxially coupled to one another;

an index arm having an inner end portion which is coaxially coupled to the coaxially coupled upper and lower discs;

a coupling member coaxially interconnecting the index arm, upper disc and lower disc, permitting independent rotational motion of each of same relative to the others;

determining the linear distance between front and rear support points on the drive unit;

setting the coupling diameter value from the coupling diameter indicia of the upper disc by angular movement of the upper and lower discs relative to one another, so that said linear distance between drive unit front and rear support points is located on the indicia of the lower disc and registered with the coupling structure diameter on the inner ring portion of the upper disc;

measuring the angular alignment between coupling members of the drive and driven units to yield a measured gap offset;

positioning the index arm of the alignment calculator circular slide rule device to the measured gap offset value on the outer ring portion of the upper disc, while maintaining the upper and lower discs in their prior position relative to one another, and reading the required shim size for said angular alignment on the indicia of the lower disc, between the inner and outer ring portions of the upper disc, as aligned with the index arm; and modifying the shimmed character of the drive unit support points with shims of the calculated size determined from the alignment calculator circular slide rule device.

7. A process according to claim 6, wherein angular alignment shimming character of the drive unit support points are adjusted such that if the measured gap offset is larger at the top of the coupling structure than at the bottom thereof, shims are added to both of the drive unit rear support points, and such that if the measured gap is larger at the bottom than at the top of the coupling structure, shims are added to the drive unit front support points.

8. A process according to claim 6, wherein the alignment calculator circular slide rule device further comprises a top disc, overlying and coaxially coupled to the upper and lower discs, and underlying the index arm, having circumferentially arranged thereon indicia denoting the distance from the coupling structure to the rear support points of the drive units, and wherein the lower disc includes indicia circumferentially arranged thereon denoting the distance from the coupling structure to the front support points of the drive unit;

further comprising the steps of:

determining the linear distance between the drive unit front support points and the center line of the coupling structure between the drive and driven units, denoted as dimension A;

determining the linear distance between the coupling structure center line and the rear support points of the drive unit, denoted as dimension B;

registering the coupling structure diameter indicium on the alignment calculator circular slide rule device with the value of dimension A on the indicia of the lower disc;

aligning the dimension B on the indicia of the top disc with the coupling diameter value on the alignment calculator circular slide rule device;

moving the index arm into registration with the measured gap offset value on the indicia of the outer ring portion of the upper disc;

reading the shimming requirements for the drive unit front support points from the indicia on the lower disc, and reading the shim requirements for the drive unit rear support points from the top disc indicia, in alignment with the index arm;

when the measured gap offset is larger at the top of the coupling than at the bottom thereof, adding shims of the calculated dimensional character to drive unit support points; and when the measured gap offset is larger at the bottom of the coupling than at the top thereof, removing shims from the drive unit support points.

* * * * *

UNITED STATES PATENT AND TRADEMARK OFFICE

CERTIFICATE OF CORRECTION

PATENT NO. : 5,691,523

DATED : November 25, 1997

INVENTOR(S) : Calvo, Frank A.

It is certified that error appears in the above-indentified patent and that said Letters Patent is hereby corrected as shown below:

| | |
|---|---|
| Column 8, Line 9 | change "the from pads" to -- the front pads -- |
| Column 9, Line 2 | change "gap" to -- gap- -- |
| Column 11, Line 45 | change "indicia" to -- indicium -- |
| Column 13, Line 22 | change "fight" to -- right -- |
| Column 14, Line 44, | change "the from motor" to -- the front motor -- |

Signed and Sealed this

Seventeenth Day of February, 1998

*Attest:*

Bruce Lehman

BRUCE LEHMAN

*Attesting Officer*

*Commissioner of Patents and Trademarks*